US008175212B2

(12) United States Patent
Carr et al.

(10) Patent No.: US 8,175,212 B2
(45) Date of Patent: May 8, 2012

(54) SEED COUNTING DEVICE

(75) Inventors: Brian W. Carr, Nevada, IA (US); Andrew G. Jenkins, Nevada, IA (US); Curtis R. Hammer, Nevada, IA (US); Scott A. Sporrer, Nevada, IA (US); Adam R. Koesters, Ames, IA (US); Edward J. Plizga, Ames, IA (US); Peter B. Moore, Ames, IA (US)

(73) Assignee: Gary W. Clem, Inc., Nevada, IA (US)

( * ) Notice: Subject to any disclaimer, the term of this patent is extended or adjusted under 35 U.S.C. 154(b) by 255 days.

(21) Appl. No.: 12/692,700

(22) Filed: Jan. 25, 2010

(65) Prior Publication Data

US 2011/0182397 A1 Jul. 28, 2011

(51) Int. Cl.
*G06M 11/02* (2006.01)

(52) U.S. Cl. ..... 377/10; 377/6

(58) Field of Classification Search ..... 377/6, 10, 377/11, 17, 19, 24
See application file for complete search history.

(56) References Cited

U.S. PATENT DOCUMENTS

| | | | | |
|---|---|---|---|---|
| 4,635,215 | A * | 1/1987 | Friend | 702/128 |
| 5,635,911 | A * | 6/1997 | Landers et al. | 340/674 |
| 5,883,383 | A * | 3/1999 | Dragne | 250/222.2 |
| 6,078,635 | A | 6/2000 | DuBois | |
| 6,093,926 | A * | 7/2000 | Mertins et al. | 250/222.1 |
| 7,490,565 | B2 * | 2/2009 | Holly | 111/174 |

* cited by examiner

*Primary Examiner* — Jeffrey Zweizig
(74) *Attorney, Agent, or Firm* — Zarley Law Firm, P.L.C.

(57) ABSTRACT

A seed counting device where accuracy is maintained at higher counting rates. The seed counting device has a hopper in communication with a tray. An activator is connected to the tray to vibrate the tray. Connected to one end of the tray is a separator having sensors. Below the tray and in partial alignment with the separator is a projecting device. The projecting device projects seeds that fall from the tray past the sensors and into a seed chamber.

9 Claims, 5 Drawing Sheets

SEED COUNTING DEVICE

BACKGROUND OF THE INVENTION

The present invention is directed toward a seed counting device and more particularly a seed counting device where accuracy is maintained at higher counting rates.

Seed counting device are known in the art. For example, U.S. Pat. No. 6,078,635 by DuBois teaches a counting device that utilizes a vac line to control the flow rate of seed. While helpful, DuBois is limited as to the accuracy of the count at higher speeds and in many situations is not able to keep up with the packaging line. Other devices use a vibrating ramp or tray to control the flow rate, yet these devices also are very slow. In addition, when seeds fall off the ramp or tray they are susceptible to an inaccurate count when two or more seeds go past a sensor and are counted as one. Therefore, a need exists in the art for a counting device that addresses these deficiencies.

Therefore, an object of the present invention is to provide a counting device that maintains accuracy at a high rate of speed.

Another object of the present invention is to create a gap between seeds to permit a more accurate count.

These and other objectives will be apparent to one of ordinary skill in the art based on the following disclosure.

SUMMARY OF THE INVENTION

A seed counting device having a hopper in communication with a tray. An activator is connected to the tray to vibrate the tray. Connected to one end of the tray is a separator having sensors. Below the tray and in partial alignment with the separator is a projecting device. The projecting device projects seeds that fall from the tray past the sensors and into a seed chamber.

DETAILED DESCRIPTION OF THE PREFERRED EMBODIMENT

Figure 1:
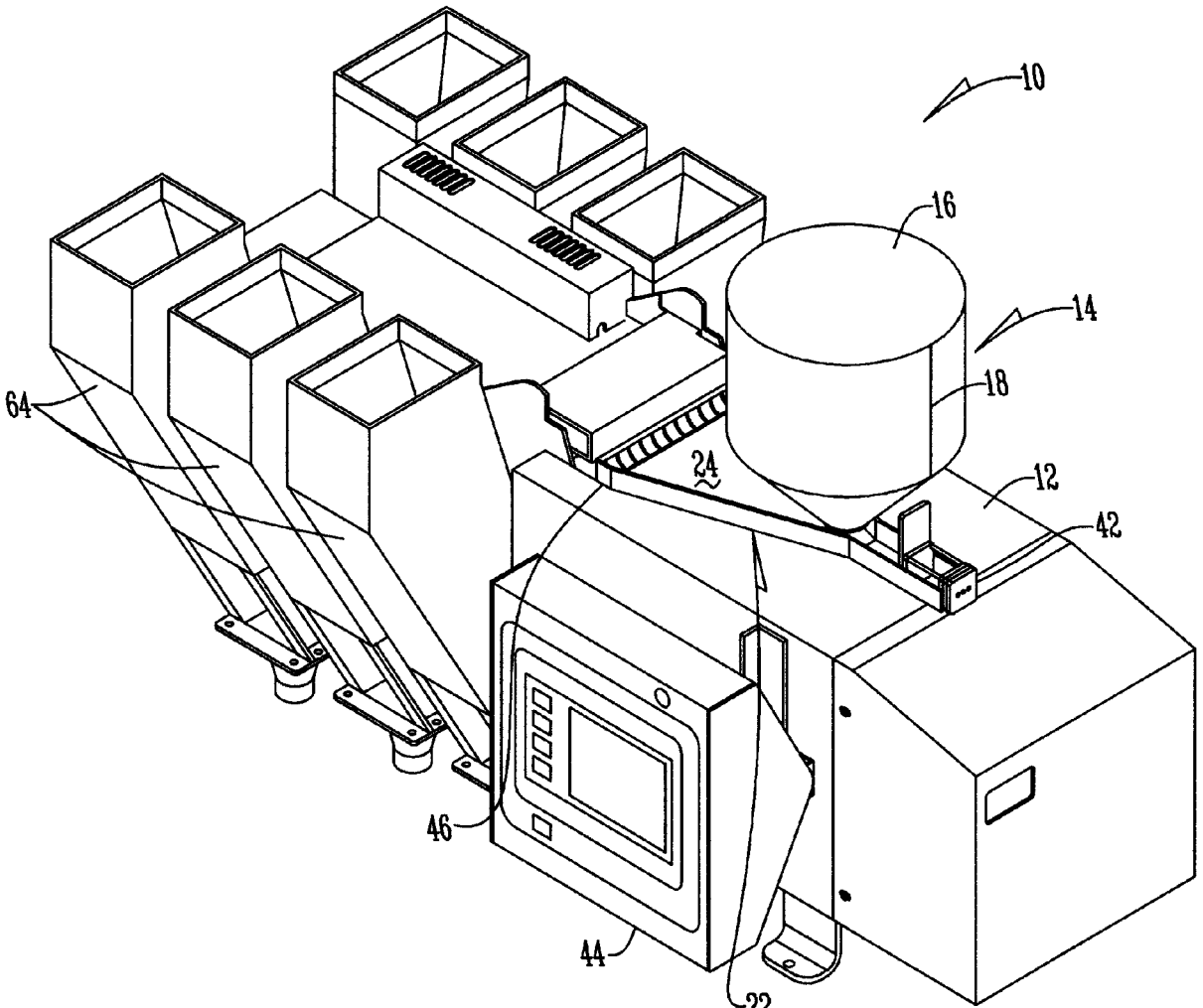
FIG. 1 is a perspective view of a seed counting device.
Figure 2:
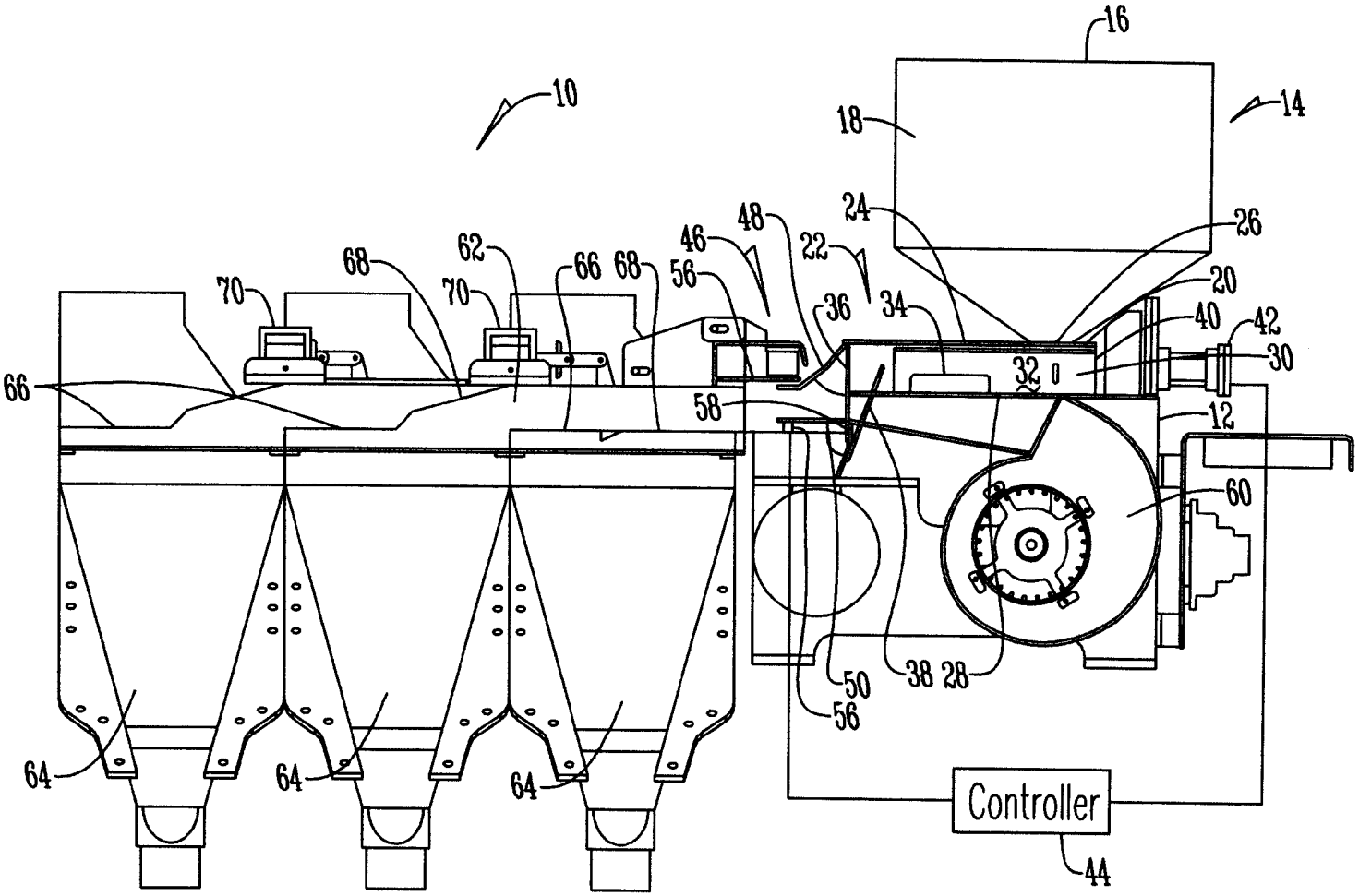
FIG. 2 is a sectional view of a seed counting device.
Figure 3:
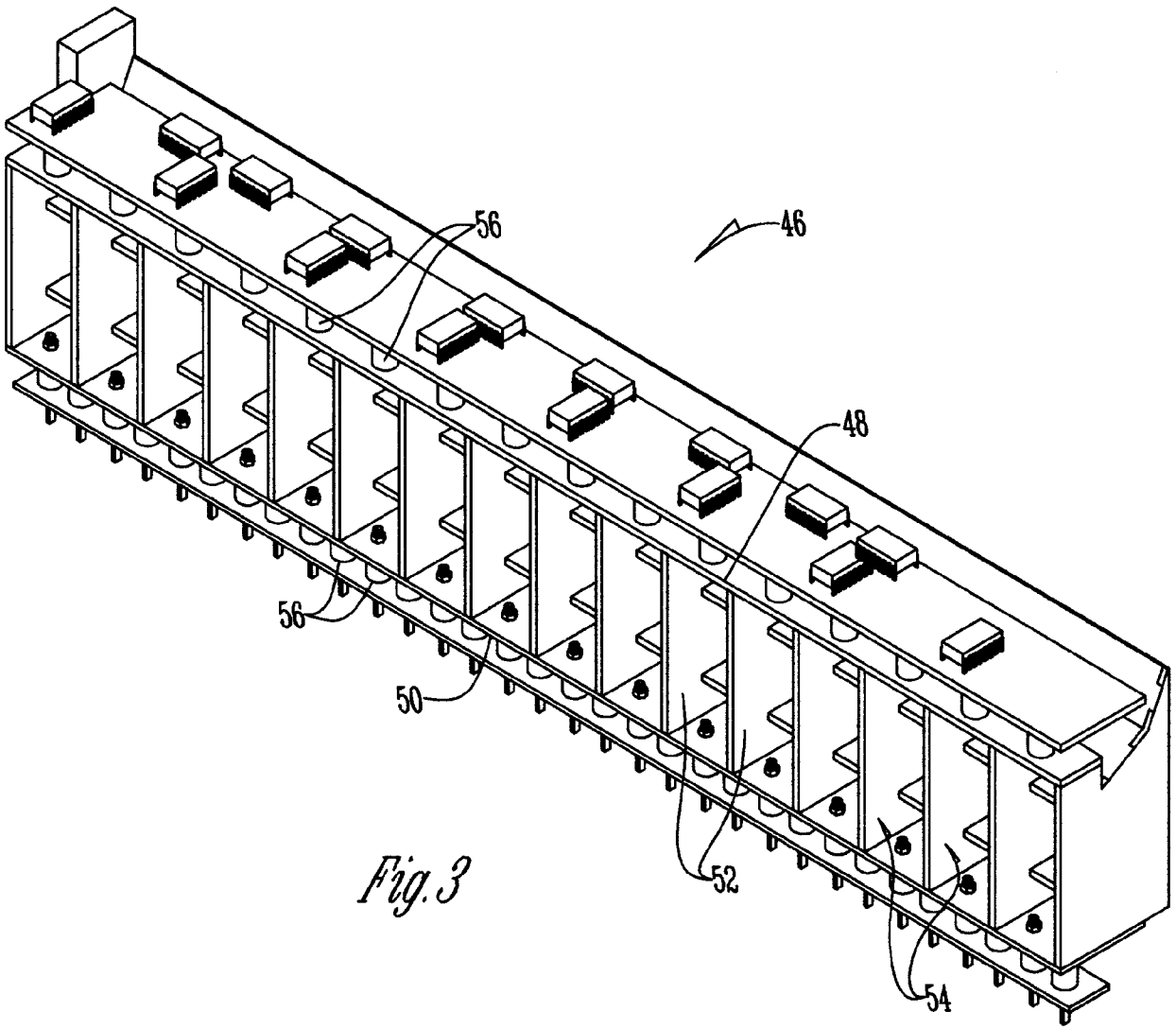
FIG. 3 is a perspective view of a separator.
Figure 4:
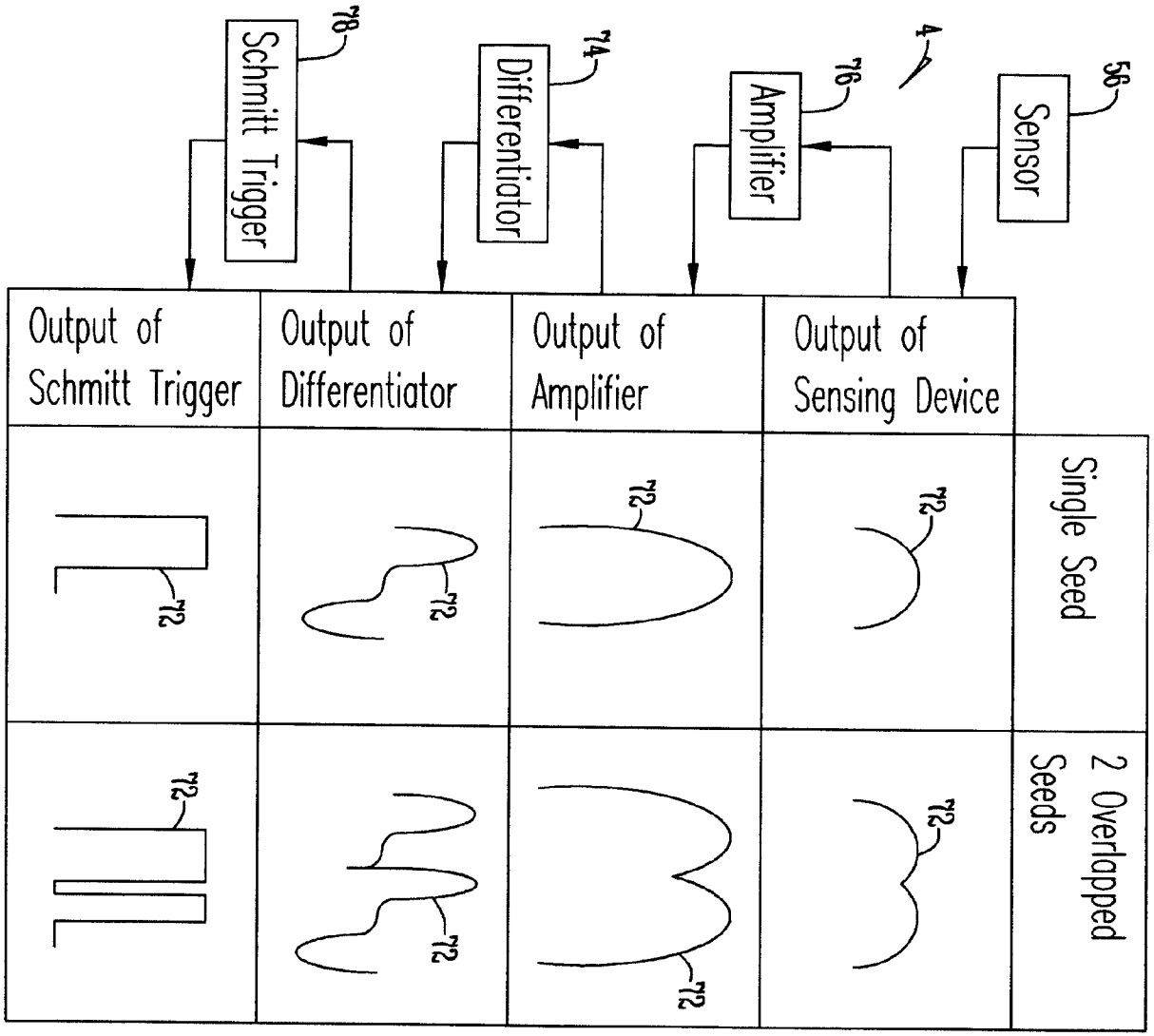
FIG. 4 is a graphical representation and flow chart of the waveforms produced by the seed counting device.
Figure 5:
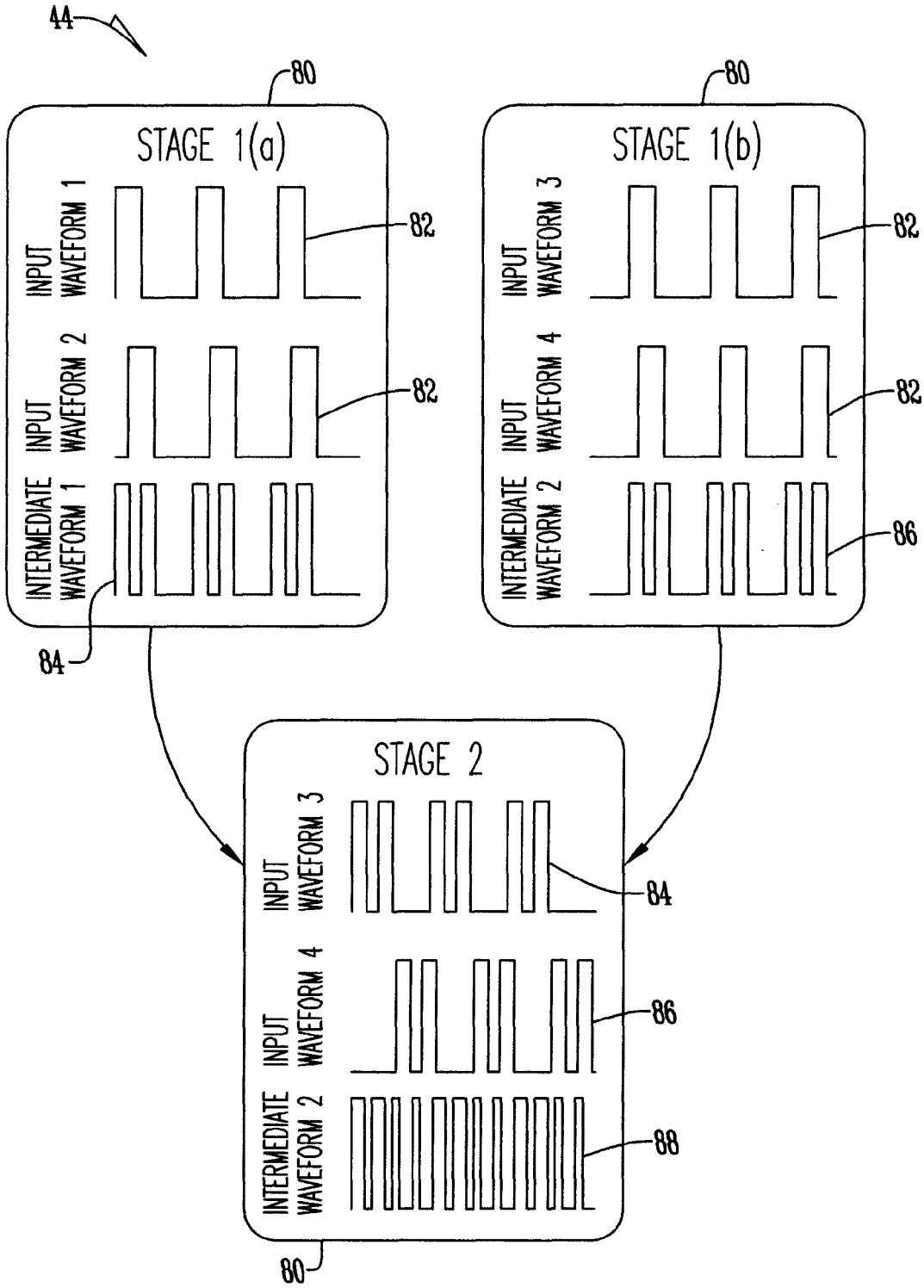
FIG. 5 is a schematic representation of the waveforms during the multiplexing process.

Referring to the Figures, a seed counting device 10 has a frame 12. Mounted to the frame is a hopper 14 that is preferably funnel shaped. The hopper 14 has an open top 16 for receiving seed, a sidewall 18 and an open bottom 20 that is in communication with a vibrating tray 22.

The vibrating tray 22 has a top 24 with an opening 26 in alignment with the open bottom of the hopper 14, a bottom wall 28 and side walls 30 that form a seed chamber 32. Preferably, within the seed chamber 32 is at least one guide 34 that assists in directing the seed within the chamber 32 from the hopper 14 to an open end 36 of the tray 22. The tray 22 is mounted to the frame 12 at the open end 36 by a pair of spring arms 38. Connected to the opposite end 40 of the tray 22 is an activator 42 that selectively engages the tray 22 to create vibration.

The activator 42 is connected to a controller 44 that sends a signal to the activator 42 based upon a predetermined rate and count. The activator 42 is of any type, size, and shape that causes the tray 22 to vibrate.

Connected to the open end 36 of the tray 22 is a separator 46. The separator 46 has a top plate 48 and a bottom plate 50 that are connected by a plurality of transverse walls 52 that create a plurality of lanes 54 between the top plate 48 and the bottom plate 50. The bottom plate 50 lies in a generally horizontal plane below the horizontal plane of the bottom wall 28 of the tray 22 so that as seeds are vibrated off of the tray 22 they will fall toward the bottom plate 50. Mounted to both the top plate 48 and the bottom plate 50 and extending therethrough are sensors 56 for detecting seeds as they pass by. The sensors are connected to the controller 44.

Positioned below the bottom wall 28 of the tray 22, and in communication with an opening 58 between the bottom wall 28 of the tray 22 and the bottom plate 50 of the separator 46 is a seed projecting device 60. The seed projecting device 60 is of any type that projects a seed forward into conduit 62 as the seed falls from tray 22 to create separation such as a paddle or a piston. Preferably the seed projecting device 60 is a blower.

The conduit 62 extends along the length of at least one and preferably a plurality of seed chambers 64. The bottom of the conduit is defined by the top 66 of each chamber 64 which includes a hingedly connected gate 68. Each gate 68 is connected to a gate activator 70 which is connected to and controlled by the controller 44. The gates 68, when in an open position, engage the top 70 of the conduit 62 to selectively direct seed into a desired chamber 64.

In operation a desired seed count is input into the controller which activates the activator 42 to vibrate tray 22 to produce the desired flow rate. Seed is then added to hopper 14 and flows through openings 20 and 26 onto the vibrating tray 22. As the tray is vibrated seed moves toward the separator 46 and into individual lanes 54. As the seed falls from the vibrating tray 22 the seed is projected past sensors 56 and into conduit 62 by the seed projecting device (i.e., blower 60). As each seed passes the sensors 56, a signal is sent to the controller 44 and the seed count is tallied wherein the sensor utilizes the high velocity of the seed to generate the seed count.

In one embodiment, the sensors 56 communicate electronically with the controller 44 and output a waveform 72 to the controller 44, wherein included in the electronics and software of the controller 44 is an amplifier 76, a differentiator 74, and a Schmitt trigger 78 to determine the slope of the incoming waveform 72 in order to increase the apparent gap between seeds, thereby utilizing the rate of change in light levels to generate the seed count as opposed to doing so by merely sensing if a light beam is blocked. Specifically, the sensor 56 first produces a sensor output in the form of a waveform 72 representative of a single seed, or two or more overlapped seeds. The sensor output waveform 72 is then transmitted to an amplifier 76 which intensifies the waveform 72 output by the sensor 56 to produce an intensified amplifier 76 output waveform 72. The intensified amplifier 76 output waveform 72 is next transmitted to the differentiator 74 wherein the rate of change in light levels of the intensified amplifier 76 output waveform 72 is sensed to generate a differentiator 74 output waveform 72 having a shape representative of the degree of change measured in the light levels of the intensified amplifier 76 output waveform 72 by the differentiator 74. Next, the differentiator 74 output waveform 72 is transmitted to a Schmitt trigger 78 (a comparator circuit that incorporates positive feedback, as known in the art). The Schmitt trigger 78 generates a Schmitt trigger 78 output waveform 72 based upon the intensity differentiator 74 output waveform 72 such that the shape of the waveform 72 output by the Schmitt trigger 78 is representative of the number of seeds sensed by the sensor 56 with an increased, more pronounced gap between successive seed reading shapes on the waveform 72 to better facilitate seed counting.

In one embodiment, multiple waveforms 72 output by the Schmitt trigger 78 are input into a multiplexer 80 as multiplexer input waveforms 82 and the input waveforms 82 are combined by the multiplexer 80 into a single multiplexer output waveform 88 for the purposes of counting as a cost saving measure and to minimize the overall physical size of the electronics and components of the controller 44. Specifically, during the first multiplexing step a first set of multiple input multiplexer waveforms 82 are input into the multiplexer 80 and combined to form a first intermediate multiplexer waveform 84 and a second set of multiple input multiplexer waveforms 82 are input into the multiplexer 80 and combined to form a second intermediate multiplexer waveform 86. During the second multiplexing step, the first and second intermediate multiplexer waveforms 84, 86 are combined to form a single output multiplexer waveform 88. Combining multiple multiplexer input waveforms 82 into a single output single multiplexer output waveform 88 is done in two stages according to an exclusive or (XOR) circuit wherein when two intermediate multiplexer waveforms 84, 86 are combined, only one of the constituent inputs is on. Alternatively, the multiplexing operation is accomplished in a single stage depending upon the available components of the controller.

A gate 68 to one chamber 64 will have been activated to an open position and the seed in conduit 62 is directed to a chamber 64. As the actual seed count nears the preset seed count the controller 44 slows the activator 42 such that the vibration of tray 22 slows. As the vibration of tray 22 slows, the rate at which seeds fall and are projected also slows permitting a more precise count to the preset seed count.

Once the desired seed count is met the controller 44 sends a signal to the gate activators 70 to close the open gate 68 and open a subsequent gate 68. The controller 44 also sends a signal to the activator 42 to set the vibration of tray 22 to a predetermined level of vibration.

Therefore, a seed counting device has been disclosed that at the very least meets all of the stated objectives.

What is claimed is:

1. A seed counting device, comprising:

a hopper mounted to a frame;

a tray connected to the frame and in communication with the hopper;

an activator connected to the tray to vibrate the tray;

a separator connected to an end of the tray having a sensor;

a projecting device positioned to project a seed received by the separator from the tray past the sensor, and into a chamber; and a controller connected to the activator and the sensor.

2. The device of claim 1 wherein the chamber has a top with a hingedly connected gate.

3. The device of claim 2 further comprising a gate activator connected to the gate and the controller.

4. The device of claim 1 wherein the projecting device is a blower.

5. The device of claim 1 wherein the vibration of the tray is based upon a number of seeds detected by the sensor.

6. The device of claim 3 wherein the gate activators are activated based upon a number of seeds detected by the sensor.

7. A method of counting seeds within a seed counting device comprising the steps of:

providing sensors in electronic communication with a controller;

providing a differentiator within the controller;

producing a sensor output in the form of a waveform;

transmitting the waveform from the sensor to the controller; and wherein the controller utilizes the rate of change in light levels of the waveform to generate a seed count.

8. The method of counting seeds within a seed counting device according to claim 7 further comprising the step of determining the slope of the incoming waveform with the differentiator to output a sensed seed reading with an increased gap between overlapping sensed seeds.

9. The method of counting seeds within a seed counting device according to claim 7 further comprising the step of inputting multiple sensed waveforms into a multiplexer and combining the multiple sensed waveforms into a single multiplexer output waveform.

* * * * *